US007842144B1

(12) United States Patent
Stiles et al.

(10) Patent No.: US 7,842,144 B1
(45) Date of Patent: Nov. 30, 2010

(54) METHODS OF MAKING DOUBLE BASE CASTING POWDER

(75) Inventors: Stephen N. Stiles, Port Tobacco, MD (US); John Luense, Accokeek, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 851 days.

(21) Appl. No.: 11/809,842

(22) Filed: Jun. 1, 2007

(51) Int. Cl.
*D03D 23/00* (2006.01)
*C06B 45/10* (2006.01)
*C06B 21/00* (2006.01)

(52) U.S. Cl. ..... 149/109.6; 149/19.8; 149/19.92; 149/97; 264/3.4

(58) Field of Classification Search ..... 149/19.8, 149/19.92, 97, 109.6; 264/3.1, 3.4

See application file for complete search history.

(56) References Cited

U.S. PATENT DOCUMENTS

| | | | | |
|---|---|---|---|---|
| 3,622,655 | A | 11/1971 | Bonyata et al. | |
| 3,907,619 | A | 9/1975 | Elrick | |
| 4,029,529 | A * | 6/1977 | Elrick et al. | 149/19.6 |
| 4,080,411 | A | 3/1978 | Stanley | |
| 4,347,087 | A * | 8/1982 | Zeller et al. | 149/98 |
| 4,701,228 | A | 10/1987 | Lagreze et al. | |
| 5,218,166 | A | 6/1993 | Schumacher | |
| 6,444,062 | B2 * | 9/2002 | O'Meara et al. | 149/109.6 |

* cited by examiner

*Primary Examiner*—Aileen Felton
(74) *Attorney, Agent, or Firm*—Fredric J. Zimmerman

(57) ABSTRACT

The invention relates to a novel process for the production of casting powder with high ntirocellulose content, and casting multiple-base rocket propellant including nitroglycerin formulated from such casting powder.

17 Claims, No Drawings

METHODS OF MAKING DOUBLE BASE CASTING POWDER

STATEMENT OF GOVERNMENT INTERESTS

The invention described herein may be manufactured and used by the Government of the United States of America for governmental purposes without payment of any royalties thereon or therefore.

FIELD OF THE INVENTION

The present invention generally relates to a process for the production of casting powder with high ntirocellulose content using nitroglycerin formulated in acetone.

BACKGROUND OF THE INVENTION

Nitrocellulose-based propellant compositions are well known in the art, having wide ranging utility in the military, aerospace, and civilian industries. For example, such propellant compositions are used as smokeless explosive charges for artillery and small arms, for solid fuel rocket engines, and in blasting compositions employed within the construction industry.

Conventional granular, nitrocellulose-based propellant compositions typically include nitrocellulose, selected organic or inorganic salts for use as ballistic modifiers or stabilizers, and other additives such as carbon black. When other energetic bases such as nitroguanidine or nitroglycerin are also added, the propellant is considered a "multiple base" propellant. Increasing the number of energetic bases within the propellant provides an effective means to enhance the muzzle velocity of the charge and thereby increase performance of the propellant.

Thus, a "single-base" propellant contains nitrocellulose with optional additives. A "double-base" propellant contains nitrocellulose as well as an additional nitroglycerin component. A "triple-base" propellant generally contains nitrocellulose, nitroglycerin, and another base such as nitroguanidine. For example, a double-base propellant is obtainable from Hercules Incorporated of Wilmington, Del., marketed and sold under the tradename Bullseye® Powder. Bullseye® Powder has a 40% nitroglycerin content, 0.75% ethylene centralite (stabilizer), 1.25% potassium sulfate (anti-glare agent), 0.40% graphite glaze and the balance nitrocellulose, the nitrocellulose having a nitrogen content of about 13.2%.

The production of conventional single-base, double-base, or triple-base propellant powders are known in the art such as set forth in U.S. Pat. No. 4,701,228 and U.S. Pat. No. 3,622,655, which are incorporated herein by reference. The basic steps according to those processes is to dissolve a dehydrated nitrocellulose in ether-alcohol or other solvent. After solvation, a selected number of additives, and if desired, nitrated oil and stabilizer, are added. The resultant slurry is cast and cured at an elevated temperature of about 43° C. to about 68° C. until a solid propellant mass is formed. The resultant dough is drawn and extruded into sheets, pulverized into the form of grains, filled into a mold, freed from liquid and dried to yield a conventional double-base explosive powder.

U.S. Pat. No. 3,907,619 discloses double-base cast propellants formulated with nitrocellulose, nitroglycerin, triacetin, tolylene diisocyanate, and nitrodiphenylamine. This patent discloses casting solvents consisting of nitrodiphenylamine, diglycol dinitrate, and the like.

U.S. Pat. No. 4,080,411 discloses casting powders where the solvents are ether, ethyl alcohol, and acetone in a ratio of 60:35:5. Similarly, U.S. Pat. No. 4,701,228 discloses casting powders produced using solvents of ether or "acetone-alcohol."

U.S. Pat. No. 5,218,166 recites the use of Bullseye® Powder from Hercules, a double-base of nitrocellulose and nitroglycerin.

Casting powders containing nitrocellulose have thus been formulated generally by incorporating additives and stabilizers, such as 2-nitrodiphenylamine (2-NDPA), to alcohol-wet nitrocellulose. Nitroglycerin is added as a solution with the solvent diethyl ether and the stabilizer 2-NDPA, and mixed in a mixer. Additional diethyl ether is added to give a total solvent loading of approximately 100%. A small amount (e.g., 1%) of pulling solvent, such as acetone, is added at the end of the mixing stage to promote nitrocellulose fibers adhering to each other through the finishing stages of blocking, billeting, finish pressing and cutting. This process is applicable to mix batches of over 200 pounds in a 100 gallon mixer.

The process known in the art, relying on diethyl ether, suffers from several disadvantages. One disadvantage is the requirement for large quantities of the expensive and hazardous solvent diethyl ether. In a typical 220 pound mix batch prepared conventionally as described above, fully 165 pounds of diethyl ether is used, along with 55 pounds of ethanol. The binary solvent achieves a 100% solvent load in a ratio of 3:1 diethyl ether to ethyl alcohol. Another disadvantage is that nitroglycerin, which is typically purchased from a third party, is typically shipped in the solvent acetone. Accordingly, the use of acetone during shipping renders the nitroglycerin unsuitable for use, directly, in the above process where one desires to manufacture a casting powder and propellant containing nitroglycerin.

The art is in need of a process for producing casting powders and multiple-base propellants, which overcomes the disadvantages of previously used processes. In particular, the art is in need of a process that allows for a significant reduction in the use of diethyl ether, and the direct use of nitroglycerin formulated in acetone. Applicant's invention unexpectedly addresses these needs.

SUMMARY OF THE INVENTION

An aspect of exemplary embodiments of the present invention discloses a process for the production of high nitrocellulose content casting powders and multiple base propellants including nitroglycerin, where the solvent diethyl ether may be used in far smaller quantities than the previous, conventional processes. Particularly, the invention provides a process where the solvent system is a ternary solvent system in a ratio of about 3:1:1 ethanol to acetone to diethyl ether thus yielding a total solvent load of about 63%. Accordingly, the diethyl ether component may be drastically reduced. Further, the invention provides a process where the nitroglycerin may be used as formulated in acetone, and therefore may be purchased from a third party.

Another aspect of exemplary embodiments of the present invention discloses a process for producing double base casting powder may include the steps of: mixing ethanol-wet nitrocellulose and additives to form a mixture; adding to the mixture a solution of nitroglycerine dissolved in acetone and 2-NDPA to form a nitroglycerine mixture; adding ethanol to the nitroglycerine mixture with further mixing to form a nitroglycerine mixture with increased ethanol content; optionally evaporating a portion of the acetone from the mixture; adding ethanol and diethyl ether to the mixture; and post-processing the mixture to form a double base casting powder.

Yet another aspect of an exemplary embodiment of the present invention discloses additives selected from burn rate modifiers, stabilizers, and other useful additives, in which at least one may be more particularly selected from 2-NDPA, lead beta-resorcylate, lead salicylate, and carbon black.

Yet another aspect of an exemplary embodiment of the present invention discloses the mixture of ethanol-wet nitrocellulose and additives includes by weight about 90%-about 95% ethanol wet nitrocellulose, about 2%-about 4% lead beta-resorcylate, about 2%-about 4% lead salicylate, about 0.2%-about 0.4% carbon black, and about 1%-about 2% 2-NDPA. In another aspect of an exemplary embodiment of the present invention, the nitroglycerine solution includes by weight about 50%-about 70% nitroglycerine, about 30%-about 50% acetone, and about 0.3%-about 1.0% 2-NDPA.

Yet another aspect of an exemplary embodiment of the present invention discloses the nitroglycerine solution dissolved in acetone and 2-NDPA, which may be added in an amount between about 25%-about 35% of the weight of the ethanol-wet nitrocellulose to form a nitroglycerine mixture. Further, the ethanol added to the nitroglycerine mixture may generally be added in an amount between about 3%-about 6% of the weight of the ethanol-wet nitrocellulose to form a nitroglycerine mixture with increased ethanol content.

In yet another aspect of an exemplary embodiment of the present invention, additional ethanol may be added to the nitroglycerine mixture (with increased ethanol content) in an amount between about 2%-about 8% of the weight of the ethanol-wet nitrocellulose. The diethyl ether added to the nitroglycerine mixture with increased ethanol content and the additional ethanol is generally in an amount between about 10%-about 20% of the weight of the ethanol-wet nitrocellulose.

DETAILED DESCRIPTION OF EXEMPLARY EMBODIMENTS OF THE INVENTION

An aspect of an exemplary embodiment of the present invention discloses a process to produce casting powders and multiple base propellants therefrom, including high nitrocellulose content, and being formulated with nitroglycerin solvated in acetone.

For large scale manufacture of the casting powder of the invention, generally a 100 gallon horizontal-type mixer may be used, however, alternatively sized mixers are equally amenable to practice of the invention.

Initially, ethanol-wet nitrocellulose, for example from Alliant Techsystems of Radford, Va., is added to the mixer. Generally, the nitrocellulose includes a nitrogen content between about 10%-about 15%, and more particularly between about 12.2%-about 13.2%. In an exemplary embodiment, by weight, the ethanol-wet nitrocellulose includes from about 65%-about 80% dry nitrocellulose, and more particularly about 72% dry nitrocellulose, as well as from about 20%-about 35% ethanol, and more particularly about 28% ethanol.

The mixer may be operated with the blades in a forward direction from about 30 minutes to about 120 minutes, and more particularly between about 50-about 100 minutes, and even more particularly about 75 minutes, at a temperature from about 65-about 75° C., and more particularly about 70° C. For optimization, the speed may be set and the time may be selected such that clumps of nitrocellulose can be deagglomerated. Additional solid ingredients may be added to the mixer, and may include, for example, additives, e.g., stabilizers, burn rate modifiers, and the like. The mixer may be operated for an additional about 10 minutes to about 30 minutes, and more particularly about 20 minutes, at a temperature from about 65° C.-about 75° C., and more particularly about 70° C.

"Additives" includes components added to a propellant to affect at least one of combustion, such as, "burn rate modifers", and the flame or gas property, such as, anti-stabilizing agents, energetic agents, or anti-glare agents.

Burn rate modifiers generally employed in conventional double-base propellants and already known in the art are suitable for use as additives within the present invention. By way of example, combustion accelerators may include at least one of carbon black, lead salts and copper salts, and more particularly, at least one of lead oxides, copper oxides, lead or copper salicylates, octoates, stearates, bismuth, tin, and resorcylates. Stabilizers, such as, at least one of 2-NDPA, diphenylamine (DPA), ethyl centralite (EC), N-methyl-p-nitroaniline (MNA), and the like, may also be found to be within the scope of the present invention.

Burn rate modifiers and energetics may include, at least one of lead beta resorcylate, lead salicylate and the like; oxidizing agents, such as, at least one of picric acid and guanidine nitrate, diethyleneglycoldinitrate (DEGDN), cyclotrimethylene trinitramine (RDX), and cyclotetramethylene tetranitramine (HMX); and fuels, such as, at least one of finely divided aluminum, beryllium, boron, and metal hydrides. Conventional plasticizers include both the explosive and non-explosive type. Suitable explosive plasticizers include at least one of nitroglycerin, butane triol trinitrate, diglycol dinitrate, ethylene glycol dinitrate and the like. These explosive plasticizers can be mixed with one or more miscible, non-explosive type plasticizers, such as, triacetin, dibutyl phthalate, dimethyl sebacate, dibutyl adipate and the like.

The oxidizers, energetic bases and other noted additives are generally in liquid form though these materials, if mutually antagonistic, may be microencapsulated as known in the art prior to addition to the mix.

In an exemplary embodiment, burn rate modifiers, such as, lead beta-resorcylate and lead salicylate; the stabilizers (e.g. 2-NDPA, EC, DPA, and MNA), as well as carbon black or other ballistic modifiers, are added to the mix at this time. Generally, each of the two lead compounds are added from about 2%-about 4% of the weight of ethanol-wet nitrocellulose, and more particularly about 2.8%. Carbon black is added from about 0.2%-about 0.4% of the weight of nitrocellulose, and more particularly about 0.3%. In an exemplary embodiment, 2-NDPA is added from about 1%-about 2%, and more particularly about 1.7%. The mixer may be operated for an additional about 10 to about 30 minutes, and more particularly about 20 minutes, at a temperature from about 65° C.-about 75° C., and more particularly about 70° C.

The next ingredient added to the mixer is the solution of nitroglycerin in acetone. In an exemplary embodiment, the nitroglycerin solution includes from about 50%-about 70% nitroglycerin, from about 30%-about 50% acetone, and from about 0.3%-about 1% 2-NDPA. In another exemplary embodiment, the nitroglycerin solution includes about 59.9% nitroglycerin, about 39.5% acetone, and about 0.6% 2-NDPA. This nitroglycerin solution is added to the mixer at about 25-35% of the weight of the original wet nitrocellulose weight, and more particularly about 30%, added over a period of between about 5—about 15 minutes, and more particularly about 10 minutes, with the mixer operating in the reverse direction, at a temperature from about 70° C.—about 80° C., and more particularly about 75° C.

Ethanol may be used to rinse the tank from which the nitroglycerin solution was added, and the ethanol, itself, may be added to the mixer in an amount from about 3%-about 6% of the weight of the original nitrocellulose, and more particularly about 4.3%. As a result, the ethanol content of the mixture (i.e., the added ethanol rinse plus the ethanol in the original ethanol-wet nitrocellulose) may be brought up to about 25-35%, and more particularly about 30%. In an exemplary embodiment, the mixer may be operated in reverse for a short duration of about 1 minute, at a temperature of from about 70° C.-about 80° C., and more particularly about 75° C.

The mixer lid may be opened, and a source of air stream, such as a blower, blows air across the open mixer, which is operating in a forward direction at a speed sufficiently slow to prevent material from escaping the mixer. The mixer speed generally may be from about 30 to 50 rpm, and more particularly about 40 rpm, to evaporate a substantial fraction of the acetone as well as a portion of the ethyl alcohol over a period from about 60 minutes to about 90 minutes, and more particularly about 75 minutes, at a temperature from about 70° C.-about 80° C., and more particularly about 75° C.

The temperature may be lowered to between about 40° C.-about 60° C., and more particularly about 50° C., for the addition of more solvent. Over a period of about ten minutes, ethanol and diethyl ether may be added. Ethanol may be added first, at from about 2%-about 8% of the weight of the original nitrocellulose, and more particularly about 4.5%, followed by the addition of diethyl ether from about 10%-about 20% of the weight of the original nitrocellulose, and more particularly about 14.5% of the weight of the original nitrocellulose. Further mixing may proceed for another about 3-about 10 minutes, and more particularly about 5 minutes.

The resulting mixture is ready for post-processing, such as, blocking, billeting, finish pressing and cutting, as known in the art, in order to form the double base casting powder of the invention.

EXPERIMENTAL

(Actual) Results

Example 1

Process for Producing Double Base Casting Powder

A double base casting powder was produced by a process as follows:

220 pounds of ethanol-wet nitrocellulose was added to a 100 gallon mixer. The ethanol-wet nitrocellulose had a nitrogen content of 12.6% and comprised 72% nitrocellulose and 28% ethanol.

The mixer was operated with the blades in a forward direction for 75 minutes, at a temperature of 70° C. Additional solid ingredients, the additives, were added to the mixer—6.6 pounds each of lead beta-resorcylate and lead salicylate, plus 0.7 pounds of carbon black, plus 4 pounds of the stabilizer 2-NDPA. The mixer was operated for an additional 20 minutes, forward direction, at a temperature of 70° C.

A solution of nitroglycerin was added to the mixer. The nitroglycerin solution included 66 pounds of a solution consisting of 39.8 pounds of nitroglycerin and 26.2 pounds of acetone, plus 0.4 pounds of 2-NDPA. This nitroglycerin solution thus included approximately 59.9% nitroglycerin, 39.5% acetone, and 0.6% 2-NDPA. This nitroglycerin solution was added to the mixer via the mixer's lower addition tank, and dispensed remotely over a period of 10 minutes, at a temperature of 75° C. The mixer was operated in the reverse direction during this time.

9.5 pounds of ethanol was used to rinse the lower addition tank from which the nitroglycerin solution was dispensed, and then the ethanol was itself added to the mixer. The mixer was operated in reverse for a short duration of 1 minute, at a temperature of 75° C.

The mixer lid was opened, and a blower blew a light air stream across the lid of the open mixer, which was operating in a forward direction at 40 rpm. A substantial fraction of the acetone as well as a significant portion of the ethyl alcohol was evaporated by this process over a period of 75 minutes, at a temperature of 75° C.

The temperature of the mixer was lowered to 50° C., at which point 10 pounds more ethanol were added first, then 32 pounds diethyl ether (one 20 liter can) were added second, to the mixer. The ethanol was dispensed from the lower addition tank and the ether was dispensed from the upper addition tank over a total period of about 10 minutes. The mixer operated forward for 15 minutes (including the 10 minute period over which the ethanol and diethyl were added) at 50° C.

Following post-processing (e.g., blocking, billeting, finish press, cutting and drying operations), the resulting double base casting powder was analyzed for its composition. The composition was determined to include 73.7% nitrocellulose (12.6% nitrogen content), 18% nitroglycerin, 3% lead beta-resorcylate, 3% lead salicylate, 2% 2-NDPA, and 0.3% carbon black. Further, the resulting casting powder was made with a drastically reduced requirement for diethyl ether, and was able to utilize, directly, the nitroglycerin formulated in acetone purchased commercially from a third party.

Finally, the numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

It is claimed:

1. A process for producing double base casting powder, comprising:

mixing ethanol-wet nitrocellulose and additives to form an ethanol-wet nitrocellulose mixture with additives;

adding to the ethanol-wet nitrocellulose mixture with additives, a nitroglycerine solution comprising nitroglycerine and 2-NDPA dissolved in acetone and further mixing to form a nitroglycerine mixture;

adding ethanol to the nitroglycerine mixture and further mixing to form a nitroglycerine mixture with increased ethanol content;

adding ethanol and diethyl ether to the nitroglycerine mixture with increased ethanol content to from a resultant mixture; and post-processing the resultant mixture to form the double base casting powder.

2. The process of claim 1, further comprising evaporating a portion of the acetone and the ethanol of the nitroglycerine mixture with increased ethanol content.

3. The process of claim 1, wherein the ethanol-wet nitrocellulose mixture with additives comprises by weight about 90%-about 95% said ethanol wet nitrocellulose, about 2%-about 4% lead beta-resorcylate, about 2%-about 4% lead salicylate, about 0.2%-about 0.4% carbon black, and about 1%-about 2% of 2-NDPA.

4. The process of claim 1, wherein the ethanol-wet nitrocellulose mixture with additives comprises by weight about 92.5% said ethanol wet nitrocellulose, about 2.8% lead beta-resorcylate, about 2.8% lead salicylate, about 0.3% carbon black, and about 1.7% of 2-NDPA.

5. The process of claim 1, wherein the nitroglycerine solution comprises by weight about 50%-about 70% said nitroglycerine, about 30%-about 50% said acetone, and about 0.3%-about 1.0% of said 2-NDPA.

6. The process of claim 1, wherein the nitroglycerine solution comprises by weight about 59.9% said nitroglycerin, about 39.5% said acetone, and about 0.6% of said 2-NDPA.

7. The process of claim 1, wherein the additives are selected from at least one of burn rate modifiers and stabilizers.

8. The process of claim 1, wherein the additives are at least two members selected from 2-NDPA, lead beta-resorcylate, lead salicylate, and carbon black.

9. The process of claim 7, wherein the additives are 2-NDPA, lead beta-resorcylate, lead salicylate, and carbon black.

10. The process of claim 1, wherein the nitroglycerine solution comprises an amount between about 25%-about 35% of the weight of the ethanol-wet nitrocellulose.

11. The process of claim 1, wherein the nitroglycerine solution comprises an amount of about 30% of the weight of the ethanol-wet nitrocellulose.

12. The process of claim 1, wherein the ethanol, which is added to the nitroglycerine mixture with increased ethanol content, is in an amount of between about 2%-about 8% of the weight of the ethanol-wet nitrocellulose.

13. The process of claim 11, wherein the ethanol, which is added to the nitroglycerine mixture with increased ethanol content, is in an amount of about 4.5% of the weight of the ethanol-wet nitrocellulose.

14. The process of claim 1, wherein the diethyl ether, which is added to the nitroglycerine mixture with increased ethanol content, is in an amount between about 10%-about 20% of the weight of the ethanol-wet nitrocellulose.

15. The process of claim 13, wherein the diethyl ether, which is added to the nitroglycerine mixture with increased ethanol content, is in an amount of about 14.5% of the weight of the ethanol-wet nitrocellulose.

16. The process of claim 1, wherein the ethanol, which is added to the nitroglycerine mixture, is in an amount of between about 3%-about 6% of the weight of the ethanol-wet nitrocellulose.

17. The process of claim 1, wherein the ethanol, which is added to the nitroglycerine mixture, is an amount of about 4.3% of the weight of the ethanol-wet nitrocellulose.

* * * * *